US005279628A

United States Patent [19]

Hutchens et al.

[11] Patent Number: 5,279,628

[45] Date of Patent: Jan. 18, 1994

[54] FIRE STARTING SURVIVAL TOOL AND METHOD OF USING SAME

[75] Inventors: Douglas R. Hutchens, Lake Oswego, Oreg.; Ricky W. Stewart, Mead, Wash.

[73] Assignee: Fiskars Oy Ab, Helsinki, Finland

[21] Appl. No.: 881,844

[22] Filed: May 12, 1992

[51] Int. Cl.[5] ..... C10L 11/00

[52] U.S. Cl. ..... 44/507; 44/506; 44/508; 44/509; 44/510

[58] Field of Search ..... 44/506, 507, 508, 509, 44/510

[56] References Cited

U.S. PATENT DOCUMENTS

| | | | |
|---|---|---|---|
| 995,463 | 6/1911 | Hubert | 431/146 |
| 1,066,405 | 7/1913 | Goldstein | 431/146 |
| 1,207,631 | 12/1916 | Rokeach | 431/146 |
| 1,898,991 | 2/1933 | Cox | 431/146 |
| 2,483,437 | 10/1949 | Rizer | 431/129 |
| 3,402,029 | 9/1968 | Sampson, Jr. et al. | 44/506 |
| 3,471,246 | 10/1969 | Piffath et al. | 431/150 |
| 4,188,192 | 2/1980 | Levenson et al. | 44/510 |
| 4,698,068 | 10/1987 | Jensen | 44/507 |
| 4,770,669 | 9/1988 | Allen et al. | 44/510 |

*Primary Examiner*—Ellen M. McAvoy
*Attorney, Agent, or Firm*—Foley & Lardner

[57] ABSTRACT

A fire starting kit is configured for easy lighting of fires, particularly by those involved in camping and other outdoor activities. The fire starting kit includes an elongated hollow case having a first casing section and a second casing section which fit together. A pyrophoric element is mounted to one of the casing sections and is enclosed by the case when both casing sections are fitted together. A separate striker is also contained within the case and may be used with the pyrophoric element to create sparks. Also included in the case is a tinder which may be removed and ignited by bringing the striker and the pyrophoric element into contact with each other.

20 Claims, 4 Drawing Sheets

FIRE STARTING SURVIVAL TOOL AND METHOD OF USING SAME

TECHNICAL FIELD

The present invention relates, generally, to fire starting tools and, more particularly, to a fire starting kit of the type comprising a supply of ignitable material, a pyrophoric element, and a striker.

BACKGROUND OF THE INVENTION

Fire starting tools are widely used by those involved in camping and other outdoor activities. There are presently many different types of fire igniting devices capable of lighting outdoor fires made of branches or the like, of which matches are the most common. However, matches are difficult to handle in high-wind situations, and the amount of heat generated by a match is typically insufficient to kindle fires in rainy or cold weather conditions. Moreover, matches become useless when wet.

Other devices widely used to kindle fires include various types of lighters, in which a supply of fuel such as butane, alcohol or the like is stored in a reservoir within the body of the lighter. Conventional lighters, such as those described in U.S. Pat. No. 1,898,991 to Cox and U.S. Pat. No. 1,066,405 to Goldstein, operate on the principle of dispensing such supply of fuel from the body of the lighter and igniting it with a spark created by the operation of a striker against a pyrophoric element, also called a flint. Cigarette or cigar lighters therefore present the advantage of providing a flame that will typically last longer than that of a match. However, lighters have some of the same disadvantages as matches. More particularly, lighters are similarly difficult to handle in windy or rainy conditions.

In light of the many drawbacks and limitations of conventional matches and lighters, lighting kits, more suitable for lighting outdoor fires, have been developed. See for example, U.S. Pat. No. 3,402,029 to Sampson, U.S. Pat. No. 4,188,192 to Levenson and U.S. Pat. No. 4,698,068 to Jensen, which disclose various combinations of magnesium-based ignitable material with a pyrophoric element and a striker. More particularly, U.S. Pat. No. 3,402,029 discloses a method of kindling fires using a particular magnesium alloy as the igniting material. This method basically includes the steps of producing some shavings of ignitable material from a stick of Mischmetal-magnesium alloy and subsequently striking the stick itself with a hard object (the stick thereby also serving as the pyrophoric element) to create a spark to ignite the shavings. U.S. Pat. No. 4,188,192 to Levenson discloses a fire starting apparatus comprising a body of shavable magnesium-based alloy and a separate pyrophoric element secured to the body. The apparatus accordingly provides a single composite structure serving both as the source of magnesium shavings and as the spark generating element. In both of these devices, the striker is not provided with the unit. Devices of this type generally produce the dazzling white flame and high temperatures characteristic of the instantaneous combustion of magnesium.

U.S. Pat. No. 4,698,068 to Jensen discloses a fire igniting device having a case adapted to receive a rod of shavable magnesium and a small pyrophoric element secured to the rod. A striker, attached to the outside of the case, is also provided to scrape shavings of magnesium and to create a spark when the striker is brought into contact with the pyrophoric element. Fire starting tools according to the Jensen patent, although more practical and effective than those disclosed in earlier patents, have several limitations. First, the user must produce shavings of flammable material as a step of the fire starting process. Second, it is desirable for the tool to be suited for repeated use. Therefore, the rod of the fire starting tool must be large enough to provide a sufficient quantity of flammable material to light more than one fire. However, although the pyrophoric element secured to the rod must be of sufficient size for ease of operation with the striker, such pyrophoric element must be small enough so as to not reduce appreciably the amount of magnesium available to create shavings necessary to light several fires. Finally, the magnesium combustion generates intense heat during a very brief moment (typically under half a minute), rendering fire lighting generally dangerous and particularly difficult under rainy or cold conditions.

Accordingly, while fire starting devices of the types described above have been used for a great number of years, the present inventors have specifically addressed solutions to the problems associated with matches, lighters, mischmetal and magnesium-type fire starting kits as more specifically identified in the foregoing. A fire starting tool should be usable in wet or windy conditions for an extended period of time, it should more durable than those using shavable ignitable material to allow for numerous fire starting, and it should be more convenient and safer to use than presently known prior art devices.

SUMMARY OF THE INVENTION

A fire starting kit according to the invention includes an ignition device, a supply of combustible tinder material, and a hollow case in which the ignition device and tinder are stored. According to one aspect of the invention, the tinder is made of a flammable material, particularly in the form of one or several solid, unitary blocks; the tinder ignites readily upon exposure to a flame or spark from the ignition device, and its surface burns steadily for an extended period thereafter while the tinder remains structurally sound.

According to another aspect of the invention, the ignition device comprises a pyrophoric element and a striker, the latter being used to strike the pyrophoric element to generate sparks. The case has a pair of casing sections which fit together. The pyrophoric element, such as a flint, is rigidly mounted on one of the casing sections and configured to fit within the case when the casing sections are fitted together. The striker, which is separate from the pyrophoric element, also fits within the case when the casing sections are fitted together, and a supply of tinder is similarly disposed within a cavity in the case. The tinder is removable from the case separately from the striker and pyrophoric element, so that the striker and pyrophoric element can be brought into contact with each other to ignite the tinder after the tinder has been removed from the case. A fire starting tool according to the invention allows lighting outdoor fires, even under windy or rainy weather conditions, more conveniently and safely.

BRIEF DESCRIPTION OF THE DRAWINGS

Preferred exemplary embodiments of the invention will hereinafter be described in conjunction with the appended drawings, wherein like numerals denote like elements, and.

DETAILED DESCRIPTION OF PREFERRED EXEMPLARY EMBODIMENTS

Figure 1:
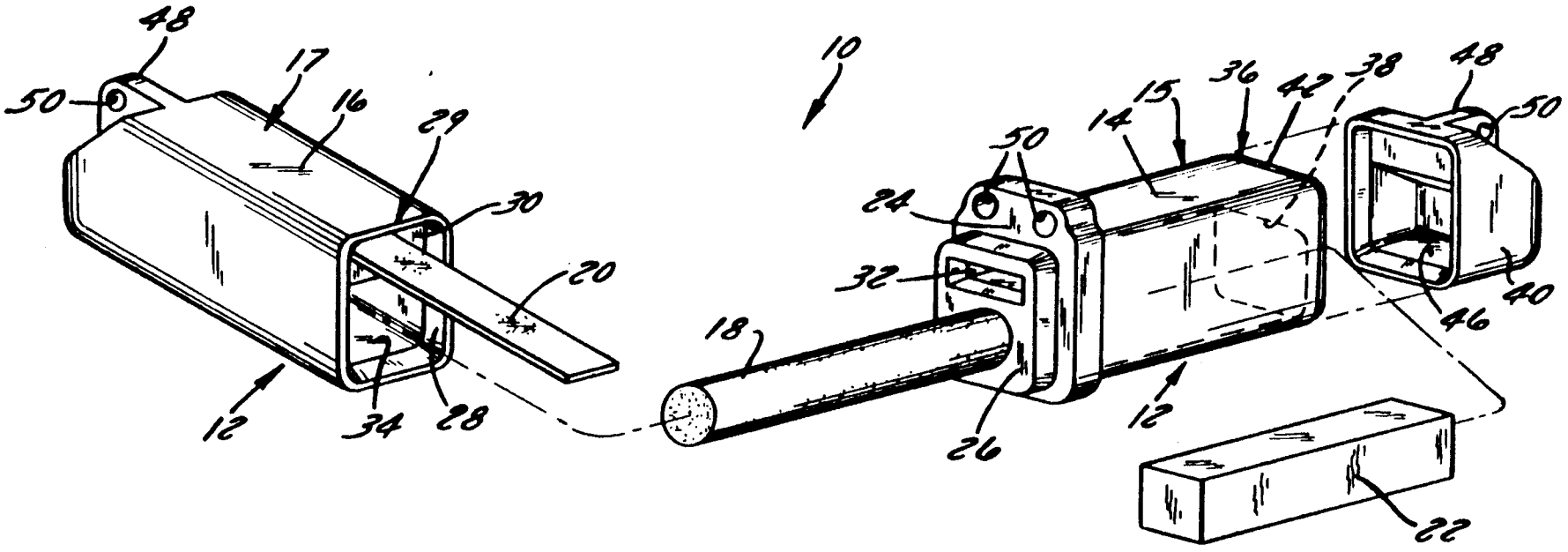
FIG. 1 is an exploded perspective view of a first embodiment of a tool in accordance with the invention.
Figure 2:
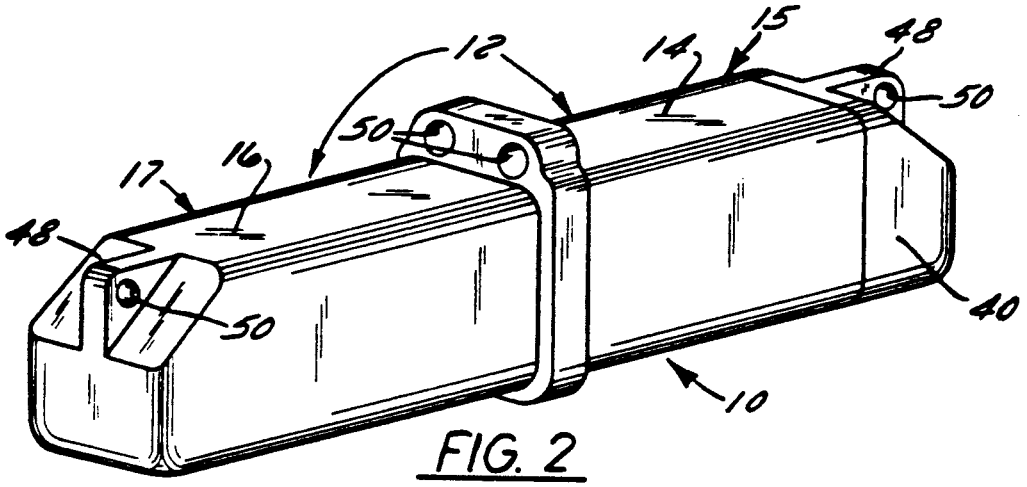
FIG. 2 is a perspective view of the tool of FIG. 1 in a stored configuration.
Figure 3:
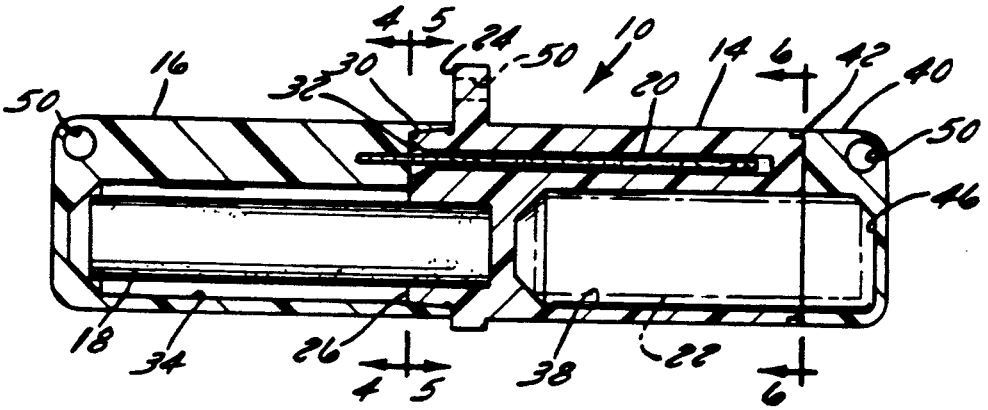
FIG. 3 is a lengthwise sectional view of the tool of FIG. 2.
Figure 4:
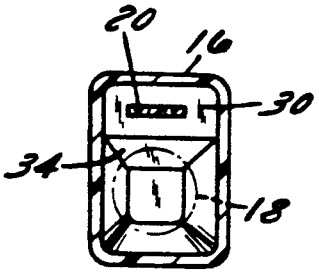
FIG. 4 is a cross-sectional view taken along line 4—4 of FIG. 3.
Figure 5:
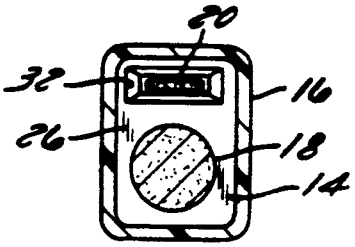
FIG. 5 is a cross-sectional view taken along line 5—5 of FIG. 3.
Figure 6:
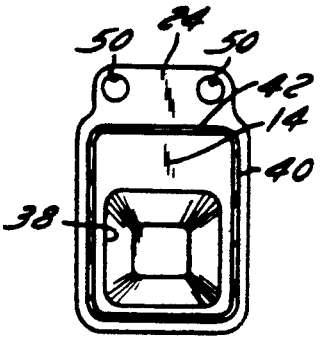
FIG. 6 is a cross-sectional view taken along line 6—6 of FIG. 3.
Figure 7:
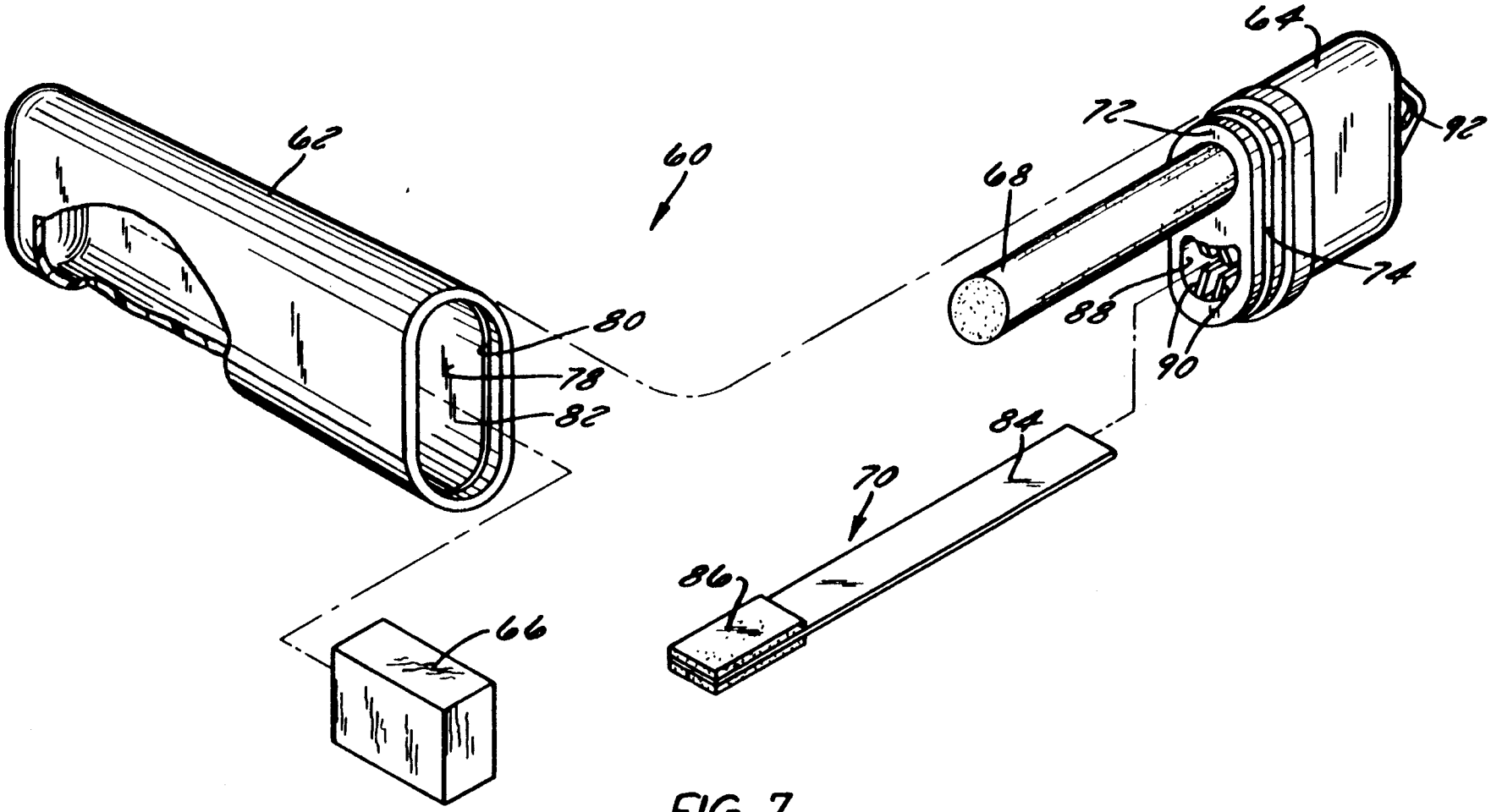
FIG. 7 is an exploded perspective view of a second embodiment of a survival tool of the invention.
Figure 8:
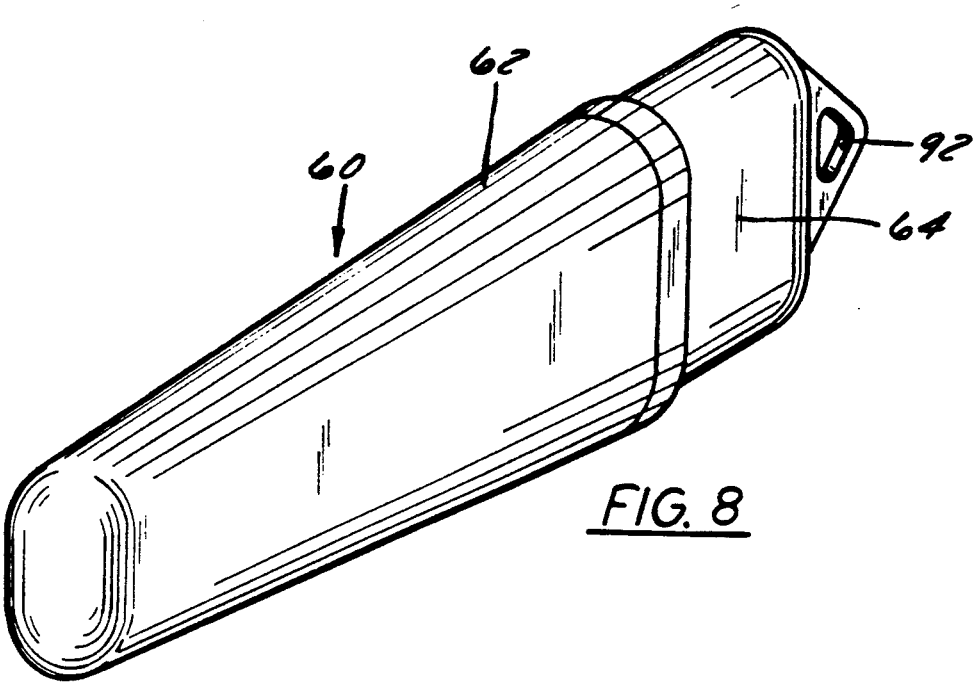
FIG. 8 is a perspective view of the tool of FIG. 7, in a stored configuration.
Figure 9:
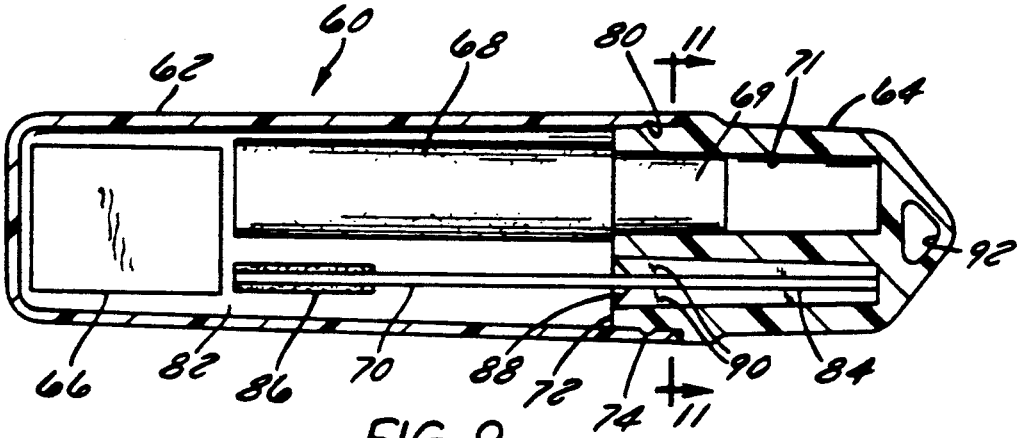
FIG. 9 is a lengthwise sectional view of the tool shown in FIG. 8.
Figure 10:
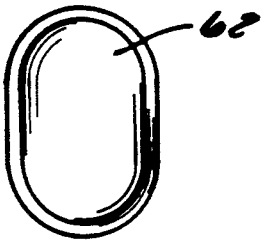
FIG. 10 is a left end-view of the tool of FIG. 8.
Figure 11:
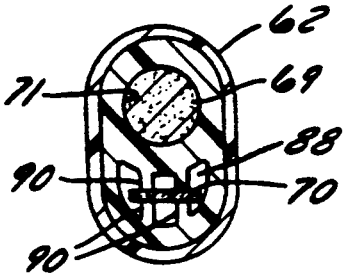
FIG. 11 is a cross-sectional view taken line 11—11 of FIG. 9; and along
Figure 12:
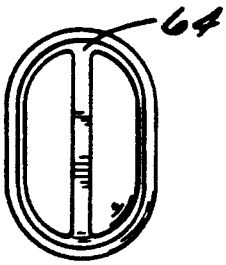
FIG. 12 is a right end-view of the tool of FIG. 8.

Referring to FIGS. 1 to 6, a fire starting kit or tool 10 of the invention includes, an elongated hollow case 12 suitably enclosing a supply of combustible tinder material 22, a pyrophoric element 18, and a striker 20. Case 12, made for example of thermoplastic material, includes a pair of casing sections 14 and 16 which fit together to enclose the fire starting implements. Casing sections 14 and 16, have respective elongated outer surfaces 15 and 17 configured as handles. Casing sections 14 and 16 fit together by any conventional means to form a moisture resistant seal. For example, a front end portion 26 of casing section 14 is press-fitted into and mates with an end opening 29 of casing section 16. The generally square outer periphery of end portion 26 is in close conforming contact with a similarly shaped inner surface 28 adjoining opening 29. A radial flange 24 on the outer surface of casing section 14 adjacent end portion 26 is provided as a wrist guard for when casing section 14 is used as a handle. Striker 20 consists of a flat bar of heat treated steel having an end portion embedded in the inwardly facing end 30 of casing section 16. When kit 10 is assembled as shown in FIGS. 2 and 3, the exposed front end portion of striker 20 slidably fits within a longitudinal slot 32 in casing section 14. Pyrophoric element 18 is made of a cerium alloy. The preferred cerium alloy also more commonly known as mischmetal, is a blend of rare earth materials. To increase hardness, cerium is combined with an iron alloy to produce ferroclum, which is a brittle material. Striking pyrophoric element 18 with a hard object such as striker 20 creates high temperature sparks. To facilitate use of pyrophoric element 18 with striker 20, an end portion of element 18 is rigidly secured to casing section 14 at end portion 26. For example, element 18 can be embedded in casing section 14 or alternatively it can be held in place using epoxy or other suitable bonding agents. When casing sections 14 and 16 are fitted together, the exposed portion of element 18 is lodged in a longitudinal cavity 34 of case section 16 so that striker 20 and element 18 are stored side-by-side in opposing directions, as shown in FIG. 3.

Case section 14 has an internal tinder storage cavity 38 rearwardly of the embedded end of element 18, which cavity 38 opens at the rear end of case section 14 opposite front end portion 26. A rear end opening 36 providing access to cavity 38 is sealed by a hollow removable cap 40 having a longitudinal cavity 46 having the same shape as cavity 38. Cap 40, is removably secured over rear opening 36 to render cavities 38 and 46, which form tinder storage compartment, moisture resistant, when cap 40 is secured to rear opening portion 36. Cap 40 is removably press-fitted over a stepped rear end portion 42 of casing section 14. When cap 40 is removed from rear opening 36, tinder 22 is partially exposed, thereby allowing the user to conveniently pull tinder 22 out of cavity 38. Casing section 16 and removable cap 40 include external end tabs 48. Tabs 48 and flange 24 have holes 50 which may be used to secure together casing sections 14 and 16 and cap 40 by means of a lanyard or clip threaded through holes 50 when kit 10 is not in use. Such lanyard may also allow the user to attach kit 10 to a belt loop or the like.

Tinder 22 consists of a highly combustible material, preferably in the form of a unitary block, such as a piece of quick-start charcoal, a paraffin wood fiber block, or the like. Preferably, tinder 22 is an item identified as "Sunbird Fire Starter", manufactured by Sunbird Products A/S, 3 Solvangsvej, DK-4681, Herfolge, Denmark, and commercially available in the U.S. from Weber-Stephen Products Co., 200 East Daniels Road, Palatine, Ill. 60067. Tinder 22 remains structurally sound as its surface burns for a significant period of time (in excess of 10 minutes), and can be readily extinguished when no longer needed. Other substances, such as ordinary tinder made of bark or small pieces of wood, may also be used as tinder 22, although such ordinary tinder does not typically offer the desirable rapid igniting capabilities and extended combustion properties of the preferred tinder, rendering such ordinary tinder less reliable and convenient to use as a component of a fire starting kit.

From the foregoing description, it should be apparent that fire starting kit 10 can be quickly and easily used by removing cap 40, removing tinder 22 from cavity 38, and exposing pyrophoric element 18 and striker 20 by disengaging casing sections 14 and 16. Tinder 22 can then be ignited by a spark generated by drawing striker 20 across pyrophoric element 18. Casing sections 14 and 16 are then refitted together to protect pyrophoric element 18 and striker 20 after use. Once it is determined that the burning branches or the like are sufficient to sustain the fire, tinder 22 is extinguished, put back into cavity 38 and re-stored by replacing removable cap 40.

Referring to FIGS. 7-12, a fire starting kit or tool 60 in accordance with a second embodiment of the invention includes a supply of combustible material 66, a pyrophoric element 68, and a striker 70. These fire starting implements are enclosed, when not in use, in a case, made for example out of thermoplastic, having an elongated hollow cover 62 and a handle 64. Cover 62 and handle 64 fit together in a conventional manner. For example, the front end portion 72 of handle 64 has a peripheral bead 74 which resiliently engages an annular mating groove 80 formed in the interior surface 78 of cover 62.

As disclosed in connection with the first embodiment of the invention, pyrophoric element 68 is preferably made of ferroclum. To facilitate use of pyrophoric element 68, a reduced diameter end portion 69 of element 68 is securely press-fitted into a hole 71 in handle 64. Alternatively, element 68 can be held in place in hole 71 using epoxy or other suitable bonding agents. When handle 64 and cover 62 fit together, the exposed portion of element 68 is lodged in a longitudinal cavity 82 of hollow cover 62. Cavity 82 is suitably shaped and dimensioned to accommodate a supply of tinder 66 and to enclose pyrophoric element 68 when cover 62 and handle 64 are fitted together. More particularly, the length of cavity 82 is greater than that of the exposed portion of pyrophoric element 68 so that tinder 66 can be stored at the bottom of cavity 82 (see FIG. 9).

Tool 60 also includes a removable striker 70 consisting of a flat handle 84, made of plastic or other material, and a head 86 made of heat treated steel, bonded to one end of handle 84. Striker 70, when not in use, is retained in a longitudinal slot 88 in handle 64 having ribs or entry prongs 90. Slot 88, which extends substantially over the length of handle 64, is substantially parallel to pyrophoric element 68, so that when handle 64 and cover 62 are fitted together, striker 70 and pyrophoric element 68 are disposed side-by-side. Resilient ribs 90 engage the surface of handle 84 of striker 70.

To operate fire starting kit 60, handle 64 and cover 62 are disengaged and tinder 66 is removed from cover 62. Subsequently, striker 70 is removed from slot 88 and drawn across pyrophoric element 68 to generate a spark to ignite tinder 66. A lanyard hole 92 is also provided in handle 64 for securing fire starting kit 60 to a belt loop or the like.

A fire starting kit according to the invention facilitates safe and repeated fire starting in windy or rainy weather conditions. All fire starting implements remain protected from inclement weather until ready for use. The user is not required to produce shavings of ignitable material. The pyrophoric element and striker are advantageously sized to permit the creation of a spark that will ignite a reusable supply of ignitable material. The ignitable material consist of a nonmagnesium-type composition, that can be readily ignited and that is capable of generating sufficient heat for an extended period of time to branches or the like, while remaining structurally sound as its surface burns.

It is understood that the above description is of two preferred exemplary embodiments of the present invention, and that the invention is not limited to the specific forms described herein. For example, the fire starting implements may be disposed within a compact case of different configuration and the various components may be of various shapes allowing for storage in a compact unit. Similarly, the tool of the invention is useful in starting any kind of fire and is not limited to outdoor use. Other types of ignition devices may be substituted for the striker and pyrophoric element, for example, a cigarette-style lighter or a sparking mechanism built into one of the casing sections, e.g., of the type wherein the user rotates a small wheel to generate sparks. These and other substitutions, modifications, changes and omissions, may be made in the design and arrangement of the elements without departing from the scope of the appended claims.

We claim:

1. A fire starting kit, comprising:

an elongated hollow case including a first casing section and a second casing section which fit together;

a pyrophoric element affixed to the first casing section and configured to fit within the case when the casing sections are fitted together;

a striker separate from the pyrophoric element, which striker is contained within the case when the casing sections are fitted together; and a supply of tinder disposed within a cavity in the case, the tinder being removable from the case separately from the striker and pyrophoric element, whereby the striker and pyrophoric element can be brought into contact with each other to ignite the tinder after the tinder has been removed from the case.

2. The fire starting kit of claim 1, wherein the first casing section has an elongated outer surface configured as a handle for the element.

3. The fire starting kit of claim 1, wherein the striker is rigidly secured to the second casing section, which also has an elongated outer surface configured as a handle.

4. The fire starting kit of claim 1, wherein the tinder comprises a solid, unitary mass of flammable material.

5. The fire starting kit of claim 4, wherein the tinder remains structurally sound as it burns.

6. The fire starting kit of claim 1, wherein the casing sections fit together at respective end openings of each section so that the case is moisture resistant.

7. The fire starting kit of claim 1, wherein the case provides three cavities for the tinder, the striker, and the element.

8. The fire starting kit of claim 7, wherein the first casing section has a tinder storage cavity that opens at one end of the first casing section opposite that to which the element is mounted, and further comprises a removable cap that seals the opening to the tinder storage cavity.

9. The fire starting kit of claim 8, wherein the cap and the first casing section snap-fit together so that the tinder storage cavity is moisture resistant.

10. The fire starting kit of claim 7, wherein the first casing section has a cavity for the striker and wherein a front end portion of the striker removably fits in the striker cavity.

11. The fire starting kit of claim 10, wherein the cavity for the striker communicates with the tinder storage cavity.

12. The fire starting kit of claim 7, wherein the second casing section has a cavity for the element.

13. The fire starting kit of claim 3, wherein one end of the striker is embedded in the second casing section, which is made of molded plastic.

14. The fire starting kit of claim 13, wherein a front end portion of the striker removably fits in a cavity in the first casing section.

15. A survival tool for lighting fires, comprising:

a) a hollow case including a handle portion and a cover portion removable from the handle portion, the hollow case being configured to receive fire starting implements suitable for repeated fire lighting operations;

b) at least one unitary mass of combustible material removably disposed within said case, the material retaining its structural integrity as its surface burns; and c) an ignition device configured to fit within the hollow case when the cover portion is attached to the handle portion, the ignition device being manually actuable by the user to ignite the material when the cover portion is removed from the handle portion.

16. The survival tool of claim 15, wherein the ignition device comprises a pyrophoric element.

17. The survival tool of claim 16 wherein the ignition device further comprises a striker.

18. The survival tool of claim 16 wherein the pyrophoric element is fixedly secured to the handle and the material is stored in the cover.

19. A method of starting a fire, using a compact fire starting kit housed in a hollow case, the kit comprising a unitary mass of combustible material and a manually activated ignition device having a striker and a pyrophoric element affixed within the case, the mass and the striker both being removably disposed within the case, said method comprising the steps of:

a) removing the mass of material and the striker from the case;

b) bringing the mass proximate the ignition device; and c) igniting the mass by activating the ignition device.

20. A method of starting a fire, using a fire starting kit comprising an elongated hollow case having a pair of casing sections which fit together, a pyrophoric element rigidly mounted on one of the casing sections, a striker separate from the pyrophoric element, the pyrophoric element and striker being configured to fit within the case when the casing sections are fitted together, and a supply of tinder disposed within a cavity in the case, the tinder being removable from the case separately from the striker and pyrophoric element, the method comprising the steps of:

a) removing the supply of tinder from the cavity;

b) separating the casing sections to expose the striker and the element; and c) drawing the striker against the element to create a spark to ignite the tinder.

* * * * *